United States Patent [19]

Simpson

[11] 4,150,763

[45] Apr. 24, 1979

[54] PAINT BRUSH SCRAPER

[76] Inventor: Catherine L. Simpson, R.R.#2, Etters, Pa. 17319

[21] Appl. No.: 892,666

[22] Filed: Apr. 3, 1978

[51] Int. Cl.[2] ..... B65D 25/00

[52] U.S. Cl. ..... 220/90; 220/1 C; 220/287

[58] Field of Search ..... 220/287, 90, 306, 355, 220/1 C; 141/333, 334, 98; 401/121, 122; 15/257.05; D9/289, 290; 222/570, 571

[56] References Cited

U.S. PATENT DOCUMENTS

| | | | |
|---|---|---|---|
| 656,855 | 8/1900 | Pimlott | 220/287 |
| 948,994 | 2/1910 | Howland | 220/1 C |
| 2,570,426 | 10/1951 | Cassidy | D9/290 X |
| 2,786,614 | 3/1957 | Giusto | 220/90 X |
| 3,221,955 | 12/1965 | Banaszak et al. | 220/90 X |
| 3,655,089 | 4/1972 | Tower | 220/287 |
| 3,844,457 | 10/1974 | Smart | 222/570 |
| 3,945,527 | 3/1976 | Pylant | 220/355 X |

*Primary Examiner*—William Price
*Assistant Examiner*—Allan N. Shoap
*Attorney, Agent, or Firm*—William C. Babcock

[57] ABSTRACT

A paint brush scraper adapted for use with conventional paint cans comprises a conical surface cut away to form a pie-shaped cut bounded by two radial edges. The peripheral edge of the cone and the exterior portions of the radial edges are provided with a peripheral lip extending on the dished side, the exterior surface of the cone being further provided with a plurality of circular ribs concentric about the apex. These ribs, once more, extend between the radial cutoffs and are dimensioned for insertion into the lid groove of standard size paint cans. By virtue of this arrangement a sharp set of radial edges is provided proximate the apex against which a brush can be wiped, the brush residue draining down towards the apex of the cone and into the paint can.

4 Claims, 4 Drawing Figures

PAINT BRUSH SCRAPER

BACKGROUND OF THE INVENTION

1. Field of the Invention

The present invention relates to paint brush scrapers, and more particularly to paint brush scrapers conformed for use with conventional paint cans.

2. Description of the Prior Art

While the prior art showed many various paint can shields and brush holders, in each instance the necessary surface convolutions of the devices require elaborate tooling. Furthermore, most of these prior art devices achieve less than satisfactory use both because of the difficulty in the engagement thereof to the paint can and typically include relatively small volumes allowing for paint spillage.

Furthermore most prior art devices of this kind did not utilize to best advantage the normal edge convolutions of the paint can and even if such were utilized only selected sizes of paint cans were accommodated within a single unit.

SUMMARY OF THE INVENTION

Accordingly, it is the general purpose and object of the present invention to provide a paint brush scraper adapted for common use with paint cans of various standard sizes.

Other objects of the invention are to provide the paint brush scraper which by virtue of its shape and flexibility may be easily cleaned of dryed paint.

Yet additional objects of the invention are to provide a paint brush scraper which is easy to produce, convenient in use and requires little maintenance.

Briefly these and other objects are accomplished within the present invention by conforming a paint brush scraper in the shape of the surface of the cone, the scraper surface being cut away along two radii to form two radial edges extending from the apex thereof. Formed around the periphery of the conically shaped paint brush scraper and extending partly along the radial cut offs thereof is a peripheral lip which both stiffens the conical surface and increases the volume of liquid that can be stored therein. The foregoing conical surface is provided with a plurality of circular ribs radially disposed about the apex thereof, the respective dimensions of each circular rib being conformed to the dimensions of the lid groove around the opening of a standard size paint can. These circular ribs are, once more, tapered along a second conical surface thus requiring expansion in order to be inserted into the lid groove. In the alternative each one of the ribs may be provided with an inwardly directed bead at the free edge thereof, once more, extended by insertion into the can.

By way of the foregoing arrangement a conical surface of enlarged dimension is secured on the open top of the paint can, the apex of the conical surface being directed into the can interior. Deployed adjacent to the apex are two sharp edges of the radial cut against which a brush may be wiped. This structure may be made of any flexible material thus allowing for clean up of the less flexible paint drippings once they have dried.

DESCRIPTION OF THE PREFERRED EMBODIMENT

Figure 1:
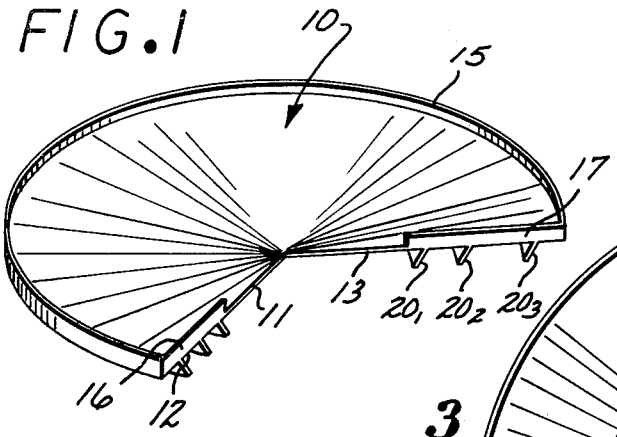
FIG. 1 is a perspective illustration of a paint brush scraper constructed according to the invention herein.

As shown in FIG. 1 an inventive paint brush scraper, generally designated by the numeral 10, comprises a conical surface 11 extending over a substantial portion of a cone, surface 11 being cut off along a radial segment bounded between two radial edges 12 and 13. In this manner surface 11 forms an apex at the juncture of edges 12 and 13, the periphery of the surface including a peripheral edge 15 extending on the dished side to expand the volume on the interior of the cone and to add stiffness. Peripheral edge 15 connects to two edge strips 16 and 17 projecting from the radial edges 12 and 13 respectively, strips 16 and 17 extending only over the outer segment of each radius. Thus the radial edges 12 and 13, adjacent the apex, form a fluid passage through which the accumulated paint is drained into a paint can P.

Figure 2:
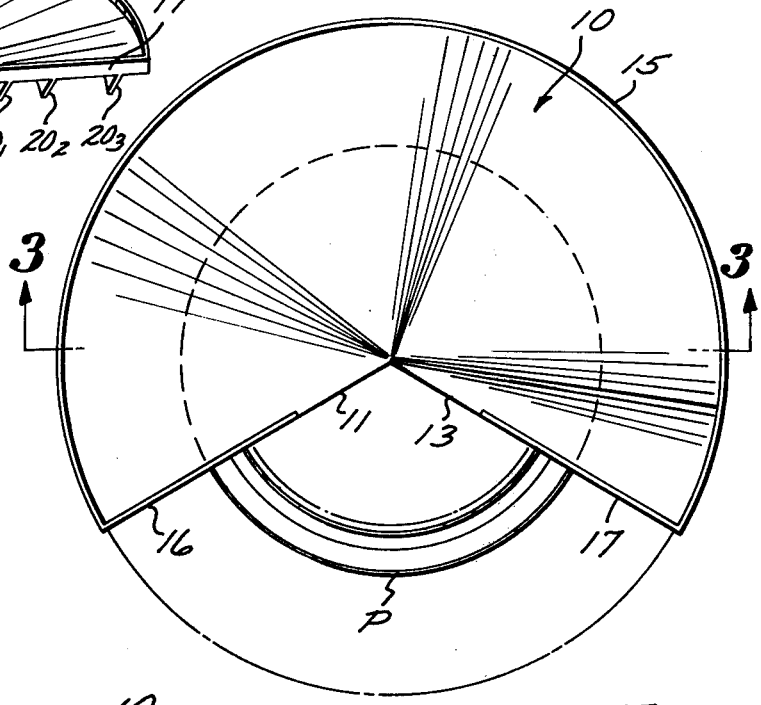
FIG. 2 is a plan view of the paint brush scraper shown in FIG. 1.
Figure 3:
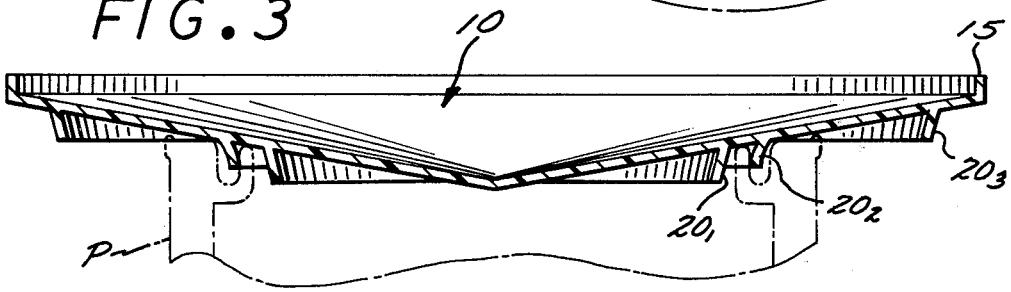
FIG. 3 is a sectional view taken along line 3—3 of FIG. 2.

As shown in FIGS. 2 and 3 the underside of the conical surface 11 is provided with a plurality of circular ribs $\mathbf{20_1}$ through $\mathbf{20_3}$, these ribs being insertable into the conventional lid groove G found in most commercially available paint cans. It is to be noted that paint cans are normally sold in quantized denominations, usually in a pint, quart or gallon sizes. Thus the radial dimensions of the peripheral groove G is usually standardized, there being three discrete lid sizes utilized in the marketplace. In order to secure the respective circular ribs $\mathbf{20_1}$–$\mathbf{20_3}$ in the groove G each circular rib is directed downwardly and inwardly along the surface of yet another cone and will therefore be expanded on the receipt within the groove.

Figure 4:
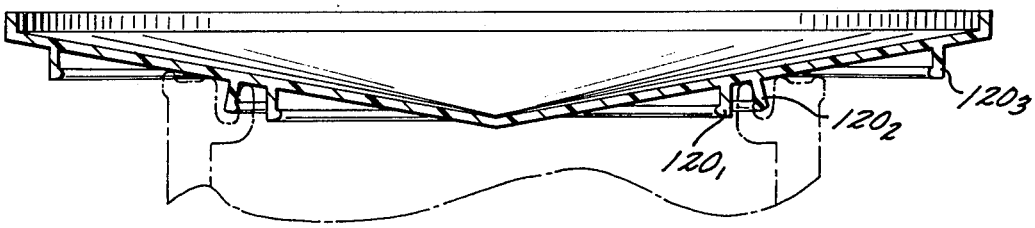
FIG. 4 is yet another sectional view illustrating an alternative implementation of the securing features disclosed herein.

In the alternative, as shown in FIG. 4, each circular rib shown herein as circular rib $\mathbf{120_1}$, $\mathbf{120_2}$ and $\mathbf{120_3}$ may include an inwardly directed edge bead $\mathbf{121_1}$, $\mathbf{121_2}$, and $\mathbf{121_3}$, the inner diameter defined by each of the beads being less than the inner diameter of groove G. Thus, once more, on installation the circular rib is deformed securing the paint scraper 10 to the paint can.

The foregoing assembly can be conveniently formed out of low density polyethylene and by appropriate selection of the wall thickness may possess the requisite flexibility in order to separate from the hardened paint deposited thereon. Thus the device disclosed herein can be conveniently cleaned by manual flexing after which the paint chips are just simply dusted away.

Some of the many advantages of the foregoing invention should now be readily apparent. As disclosed herein the invention provides a paint brush scraper which both expands the surface in which the paint brush can be layed and furthermore direct the paint brush drippings to be returned back into the paint can. This is accomplished in a device which also includes the requisite securing means to accomplish the attachment thereof within a conventional paint can.

Obviously many modifications and variations may be made to the above disclosure without departing from the spirit of the invention. It is therefore intended that the scope of the invention be determined by the claims.

What is claimed is:

1. A paint brush scraper adapted to be installed into the openings of conventional paint cans by securing in the lid grooves thereabout, comprising:

a thin walled conical surface having an exterior peripheral edge extending along a major part of a circle greater in circumference than said openings in said paint cans and having an apex aligned along a central axis common to the center of said peripheral edge, said peripheral edge and said apex defining said surface as a closed conical surface of revolution, said surface being bounded by a pie-shaped cut-out extending between first and second radial edges, each edge aligned from said apex to a corresponding end of said peripheral edge;

a peripheral strip forming a part of a tubular surface attached to said peripheral edge and extending therefrom in a direction substantially opposite to said apex;

a first and second radial segment, each segment joined at one end to the common ends of said peripheral strip and edge, each segment extending along an exterior portion of a corresponding one of said first and second radial edges, the segments, the strip, and the side of said surface adjacent thereto defining an interior side; and a plurality of partly circular ribs formed on the opposing or exterior side of said conical surface between said radial edges, said ribs being in concentric relationship relative to said apex, each said rib being conformed for receipt in said lid grooves surrounding said openings in said paint cans.

2. An apparatus according to claim 1 wherein said surface, peripheral strip, segments and ribs all comprise a unitary structure of a flexible plastic material.

3. An apparatus according to claim 2 wherein the free edges of said ribs are directed inwardly towards said apex.

4. An apparatus according to claim 2 wherein: each said ribs includes an inwardly directed bead formed on the free edge thereof.

* * * * *